US008562129B2

(12) United States Patent
Snyder et al.

(10) Patent No.: US 8,562,129 B2
(45) Date of Patent: Oct. 22, 2013

(54) SURFACE FINISHING PROCESS FOR INDIRECT OR OFFSET PRINTING COMPONENTS

(75) Inventors: Trevor James Snyder, Newburb, OR (US); David VanKouwenberg, Avon, NY (US); Jignesh Sheth, Wilsonville, OR (US); Paul McConville, Webster, NY (US); Brian Bitz, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 586 days.

(21) Appl. No.: 12/835,359

(22) Filed: Jul. 13, 2010

(65) Prior Publication Data

US 2012/0015205 A1 Jan. 19, 2012

(51) Int. Cl.
*B41J 2/01* (2006.01)

(52) U.S. Cl.
USPC ..... 347/103

(58) Field of Classification Search
None
See application file for complete search history.

(56) References Cited

U.S. PATENT DOCUMENTS

2004/0063033 A1* 4/2004 Hotta ..... 430/278.1

* cited by examiner

*Primary Examiner* — Geoffrey Mruk
*Assistant Examiner* — Bradley Thies
(74) *Attorney, Agent, or Firm* — Maginot, Moore & Beck, LLP

(57) ABSTRACT

A process for preparing an imaging surface of an imaging transfer member in a printing machine, the process comprises providing a surface roughness to the imaging surface to produce a plurality of pits having sharp features on the surface, and then exposing the pitted imaging surface to an acid dip for a time period sufficient to substantially reduce the sharp features on the imaging surface. This process may be followed by anodization. The process produces an imaging surface having a pit structure providing reduced oil consumption and wear of components of the printing machine that contact the imaging surface.

4 Claims, 2 Drawing Sheets

CONVENTIONAL ETCH / ANODIZE PROCESS

SURFACE FINISHING PROCESS FOR INDIRECT OR OFFSET PRINTING COMPONENTS

REFERENCE TO RELATED APPLICATION

The present disclosure is related to concurrently-filed application Ser. No. 12/835,557, filed on Jul. 13, 2010, now issued as U.S. Pat. No. 8,256,886, and entitled "Materials and Methods to Produce Desired Image Drum Surface Topography for Solid Ink Jet", the disclosure of which is incorporated herein by reference.

FIELD OF USE

The present disclosure relates to components used in offset or indirect printing machines. More particularly, the disclosure relates to processes for preparing the surface of such components.

BACKGROUND

In "direct" printing machines, a marking material is applied directly to a final substrate to form the image on that substrate. Other types of printing machines utilize an "indirect" or an "offset" printing technique. In this process the marking material is first applied onto an intermediate transfer member, and is subsequently transferred to a final substrate.

In one type of indirect printing machine, a piezoelectric ink jet printhead is used to apply melted solid ink to the intermediate transfer material layer. The solid ink is disposed on a liquid layer in the form of a release agent, such as oil, that is capable of supporting the printed image for subsequent transfer. The intermediate image is transferred by contact between the transfer drum and the substrate, typically with the assistance of a pressure roller or drum. An exemplary indirect printing apparatus 10 is shown in FIG. 1. In this apparatus, a printhead 11 directs a marking material, such as molten ink droplets, onto a layer 12 of intermediate transfer material to form an image 26. This transfer material layer 12 is carried by an intermediate transfer member 14, which in the illustration is a rotating drum or roller. An optional heater 19 may be provided to ensure that the ink image 26 remains molten prior to contacting the substrate 28.

The substrate 28 is conveyed between the intermediate transfer member 14 and a transfer or pressure roller 22. Optional heaters 20 and 21 may be provided to pre-heat the substrate 28 to facilitate reception of the image. Likewise, an optional heater 24 may be provided to heat the transfer roller 22. As the substrate is conveyed between the rotating rollers 14 and 22, the image 26 is transferred onto the substrate as image 26'. Appropriate pressure is maintained between the two rollers so that the image 26' is properly spread, flattened and adhered onto the substrate 28. An optional stripper 25 may be provided that assists in removing any ink remaining on the intermediate transfer member 14 prior to receiving a new ink image 26 from the printhead 11.

As shown in FIG. 1 the apparatus 10 further includes an applicator 15 that is used to apply the liquid release layer 12 onto the intermediate transfer member. The applicator 15 is mounted on a movable platform 17 that moves the applicator into contact with the intermediate roller 14 between operations of the printhead 11. A metering blade 13 is provided that meters the thickness of the liquid layer 12 as it is applied. The release layer or transfer material may be an oil, such as a fluorinated oil, mineral oil, silicone oil or certain functional oils suitable for maintaining good release properties of the image transfer member. Using the metering blade 13, the applicator 15 applies a uniform coating of the transfer material, often ranging from a thickness of 0.02 micrometer to 1.0 micrometer and above, depending upon the surface characteristics and topography of the transfer drum 14. For instance, in some transfer drums the surface onto which the transfer material is applied can have an average roughness of about 0.01 micrometers to 0.60 micrometers.

It has been found that a certain amount of surface roughness or texture on the transfer drum 14 is desirable. If the roller surface is too smooth it does not provide sufficient oil retention which allows for robust and efficient image transfer. The roughness also helps pin the image drops so that the drops cannot flow or shift as they solidify or as they are transferred from the drum 22 onto the substrate 28. On the other hand, a surface that is too rough is also undesirable. High drum surface roughness leads to low gloss levels on the final image. It can also lead to an increase in consumption of release agent material and abrasion of the other working components of the machine, such as the applicator 15, metering blade 13 and the stripper 25. Abrasion of the metering blade 13 can be particularly problematic because abrasion can compromise the ability of the blade to produce a sufficiently low and uniform release layer 12 across the entire width and circumference of the drum 14. Moreover, as the metering blade wears the thickness of the release layer 12 increases. This leads to increased oil consumption and also degradation of print quality, especially in duplex printing modes. Also, increased oil consumption can lead to increases in operational costs. On the other hand, a very low surface texture or a surface that is too smooth (i.e., low oil retention) can lead to stripper smudges, high gloss levels and/or image dropout on the printed image.

SUMMARY

According to aspects illustrated herein, a process for preparing an imaging surface of an imaging transfer member in a printing machine comprises providing a surface roughness to the imaging surface to produce a plurality of pits having sharp features on the surface, and then exposing the pitted imaging surface to an acid dip for a time period sufficient to substantially reduce the sharp features on the imaging surface. The treated surface may then be anodized after the acid dip exposure to provide a hard and durable surface.

In another aspect, an imaging transfer member for a printing machine includes an imaging surface having an average surface roughness of about 0.2 to 0.4 micrometers and an average maximum profile peak height of about 0.2 to 0.5 micrometers.

In a further feature disclosed herein, an imaging transfer member for a printing machine has an imaging surface prepared by a process comprising providing a surface roughness to the imaging surface to produce a plurality of pits having sharp features on the surface and then exposing the pitted imaging surface to an acid dip for a time period sufficient to substantially reduce the sharp features on the imaging surface.

DESCRIPTION OF THE FIGURES

FIG. 4 is a graph of oil consumption versus print count for a surface treated transfer drum in a printing machine.

FIGS. 5*a, b* are SEM pictures of an aluminum surface subject to aluminum oxide blasting, without and with acid, according to the present disclosure.

FIGS. 6*a, b* are SEM pictures of an aluminum surface subject to glass bead blasting, without and with acid, according to the present disclosure.

FIG. 7 is an SEM picture of an aluminum surface that has been pre-anodized and subject to an acid dip according to the present disclosure.

FIG. 8 is an SEM picture of an aluminum surface that has been pre-anodized and subject to a caustic etch according to the present disclosure.

DETAILED DESCRIPTION

Figure 1:
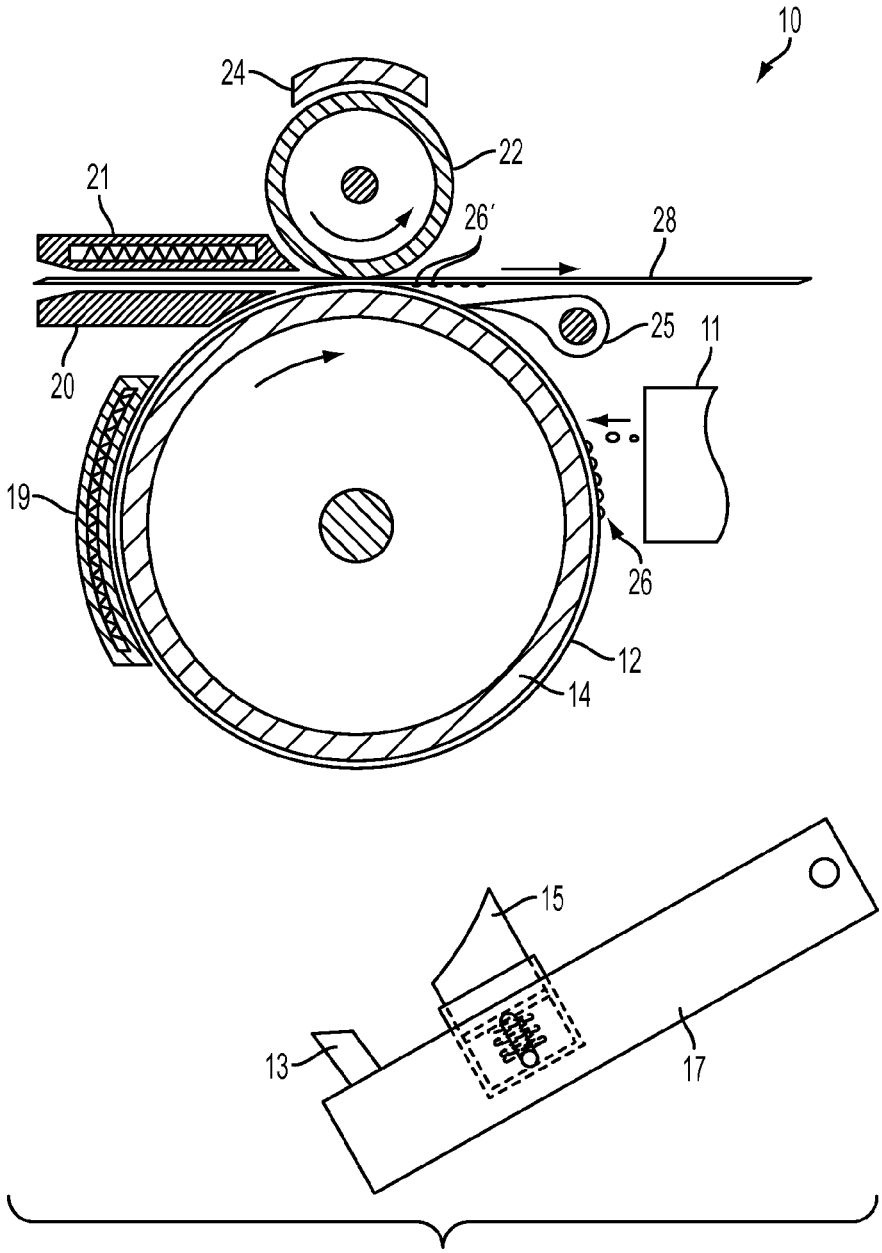
FIG. 1 PRIOR ART
FIG. 1 is a diagrammatic illustration of an indirect or offset printing apparatus.

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

For instance, exemplary embodiments provide an image transfer member having a surface texture and topography useful for solid ink marking systems and methods for controlling the surface texture during its formation. In one embodiment, the image transfer member may be the intermediate transfer drum 14 described above. In certain indirect or offset printing machines the drum 14 is an aluminum drum on which the surface has been treated to provide surface topography or features beneficial to the printing process. As discussed above, the surface incorporates a texture or topography that facilitates retention of the release layer 12 which generally includes a plurality of pits or depressions that can retain some amount of the oil forming the release layer. The depressions may be separated by a plurality of pit protuberances. In embodiments, this surface topography can include nano- or micro-surface structures with various regular and irregular configurations, including protruding or intrusive features. For instance, the pit structures and/or pit protuberances may have various cross-sectional shapes, such as square, rectangle, circle, star, or any other suitable shape.

While not intending to be bound by any particular theory, it is believed that high pit density and small pit size can provide desirable surface roughness and oil consumption rate. In embodiments, the image drum 14 can have an average pit density ranging from about 50 per millimeter square to about 10000 per millimeter square, or ranging from about 100 per millimeter square to about 5000 per millimeter square, or ranging from about 500 per millimeter square to about 2500 per millimeter square. In embodiments, the average pit size or a mean pit diameter can range from about 0.1 micrometers to about 15 micrometers, or from about 1 micrometer to about 10 micrometers, or from about 2 micrometers to about 8 micrometers. In embodiments, the image drum 120 can have an average pit depth or pit height ranging from about 0.1 micrometers to about 15 micrometers, or from about 0.1 micrometers to about 10 micrometers, or from about 2 micrometers to about 8 micrometers.

In a typical process these surface features are created by caustic etching of the surface of the aluminum drum. In certain processes, sodium hydroxide is used to etch the drum by removing aluminum from the surface. The nature of the pit structure on the drum surface is determined by the duration of the etching process before the caustic etching material is rinsed from the drum. Once the etching process has been terminated, the etched drum is desmutted to remove any residue of the process and rinsed. The drum is then anodized to provide a uniform protective layer on the surface while retaining the pit structure. This conventional process produces a drum surface having a pit density of 50 to 500 pits per millimeter square.

Figure 2:
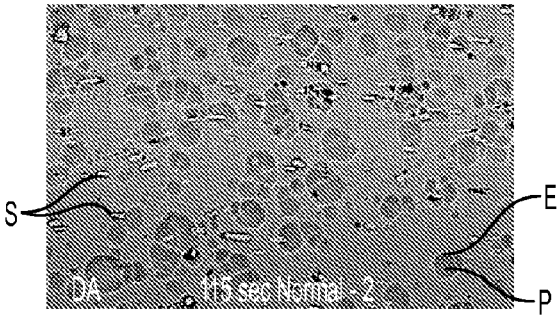
FIG. 2 PRIOR ART
FIG. 2 is an SEM picture of an aluminum surface that has been caustic etched and anodized accordingly to a conventional process.

A surface obtained using this conventional process is shown in the microscopic (SEM) image in FIG. 2. As this image reflects, the edges E of the pits P are sharply defined which indicative of sharp edges at the pit boundary. In addition, the surface includes a plurality of sharp intermetallic particles or protrusions S that appear as lighter shaded generally oblong features in FIG. 2. These sharp features E and S decrease the life of the applicator 15 and most particularly of the metering blade 13. In addition, these surface irregularities lead to increased oil consumption throughout the life of the drum.

In accordance with a feature of the present disclosure, methods are provided to reduce the presence of the sharp edges E and surface protrusions S without sacrificing the desirable pit or pore structure P on the surface of the aluminum drum. In one method, the drum surface is placed in an acid dip for a predetermined period of time. The acid dip removes the sharp intermetallic protrusions S and microscopically smooths the pit edges E. The acid dip in one process includes at least about 80% phosphoric acid ($H_3PO_4$), water and nitric acid ($HNO_3$) having a specific gravity of about 1.65. In one acid dip, the nitric acid concentration may be about 3-4% and the water about 10%, with the remainder being the phosphoric acid. A fume suppressant may be added, such as dyammonium phosphate or urea, at a concentration of about 2%. Copper may also be added at about 1000 ppm. In another acid dip sulfuric acid is added to the nitric acid, water and phosphoric acid solution. The relative concentrations may be about 2-4% nitric acid, 10% water, 15-20% sulfuric acid and the remainder phosphoric acid, for a specific gravity of about 1.70. The specific gravity may be adjusted by adding water to the solution. The acid dip process may be optimally run at a temperature over 212° F. to boil off the water byproduct of the acid dip reaction.

The length of time in the acid dip determines the amount of impact on the surface features. In one example, a test surface was etched and anodized according to the conventional process, yielding surfaces features such as those shown in FIG. 2, including the surface protrusions and the sharp edges to the pits. The test surface was then subject to the acid dip described above for 30 seconds, resulting in the modified surface features shown in FIG. 3*a*. After this 30 s dip, the protrusions or intermetallic particles are virtually eliminated. The edges E of the pits P are still prominent but less sharp than after the conventional process. A second test surface was prepared and exposed to the same acid dip for 60 seconds, producing the modified surface shown in FIG. 3*b*. The edges E of the pit P are significantly smoother.

In both acid dips (30 s and 60 s) the basic pit structure is retained, which maintains the oil retention characteristics needed for optimal functioning of the transfer drum, so that there is no sacrifice in print quality output of the printing machine. However, the sharp features found in the conventionally-prepared surface are substantially eliminated, which significantly reduces the abrasion of the metering blade. This reduction in abrasive effects manifests in dramatically reduced oil consumption at time zero (first use) and over the entire life of the transfer drum. As shown in the graph of FIG. 4, the family of data points representing the conventionally prepared drum surface (caustic etched and anodized only) show an oil consumption of about 10 mg/page (although a typical range may be 4-10 mg/page) from time zero that increases 3-4 mg/page over a 250,000 page count. In contrast, the family of data points representing drum surfaces subjected to the acid dip described above show an initial oil consumption of about 2 mg/page and only about a 0.5 mg/page increase at the 250,000 page count. It can be readily understood that this difference in per page oil consumption will result in a significant reduction in total oil usage over the life of a transfer drum. This capability allows a reasonably small amount of oil to approach over a million pages. This dramatically reduces the need for customer interventions and reduces cost per copy and the environmental impact of printing.

Aluminum surfaces prepared using the conventional caustic etch/anodize techniques have a typical average roughness (Ra) of 0.2 to 0.6 micrometers and an average maximum profile peak height (Rp) of 0.6 to 0.9 micrometers. With the acid dip step described above, the aluminum surface may exhibit an average roughness of 0.2 to 0.4 micrometers and an average maximum profile peak height of 0.2 to 0.5 micrometers. In certain embodiments the process described above may yield an average surface roughness ranging from about 0.05 micrometers to about 0.7 micrometers, and an average maximum profile peak height of about 0.6 micrometers or less. The pit density and pit size following the acid dip are equivalent to the conventional process. Thus, while the surface roughness after the acid dip remains within the range of the conventional process, the Rp value is significantly different, falling outside the peak height range for the conventional process. It is believed that this difference contributes significantly to minimizing blade wear while optimizing oil usage.

In another aspect, the conventional caustic etch and anodize process for drum surface preparation is modified to incorporate mechanical roughening techniques. According to this aspect, the microstructure or pit structure of the drum surface may be controlled more accurately than the conventional caustic etch process. In one specific aspect, the mechanical roughening process is used to create an excessive amount of texture with very large pit structures having sharp features. This process is then augmented with the acid dip described above to produce a drum surface that increases blade life and reduces oil consumption without sacrificing print quality.

In lieu of or in addition to the caustic etch, a mechanical roughening step can be applied. There are many possible mechanical roughening methods such as abrasive blasting, sanding or superfinishing, or wire buffing. One disclosed method involves abrasive blasting which utilizes high pressure to force a stream of abrasive material against the drum in order to roughen its surface. Many different abrasive media may be used including ground glass or beads, oxides such as aluminum, silicon carbide, metallic particles, synthetic particles such as plastic, or organic particles such as corn cob or shells.

Abrasive blasting with aluminum oxide and glass bead were tested and both were found to produce sufficiently large and dense structures, as shown in FIGS. 5*a* and 6*a*, respectively. The abrasive blasting in these tests used 80-120 psi of pressure with media particles having Mohs scale hardness of 2.0 up to 9.0 and particle sizes from 10 up to about 150 micrometers. Following the mechanical blasting the surface may be placed in an acid dip, as described above, to produce the smoothed surfaces shown in FIGS. 5*b* and 6*b*. The surface is then anodized to provide the protective layer which completes the process. With the mechanical roughening step described above, the aluminum surface exhibits an average roughness ranging, for example, from about 0.2 to 0.4 micrometers and an average maximum profile peak height of 0.2 to 0.5 micrometers. The pit density and pit size is equivalent to that produced using conventional caustic etch/anodizing techniques.

Figure 3A:
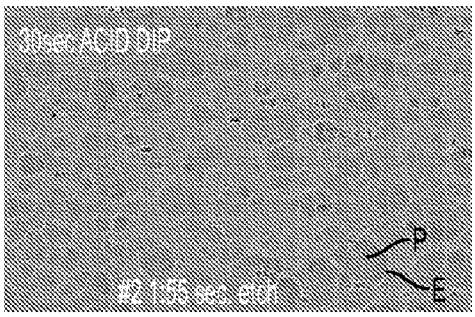
FIGS. 3*a, b* are SEM pictures of an etched aluminum surface that has been exposed to an acid dip for 30 seconds and 60 seconds, respectively, according to the present disclosure
Figure 3B:
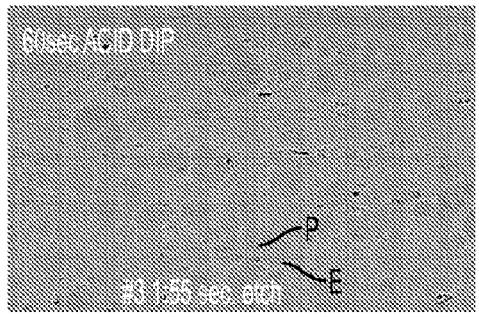

It can be appreciated that the mechanical roughening process tends to generate larger pit structures than the caustic etch process, when both processes are followed by the acid dip, as demonstrated by a comparison of the etched and acid dipped surface in FIG. 3*a* to the blasted and acid dipped surfaces in FIGS. 5*b* and 6*b*.

In a further disclosed feature, a pre-anodizing step is integrated into the process for preparing the surface of the transfer drum. In this modified process, the drum surface is cleaned and then anodized before any surface roughening step. Standard anodizing techniques for aluminum surface may be utilized. It is known that the anodizing process does not create any substantial roughness on its own and will not provide sufficient pit structure to provide for proper oil retention and preserve print quality. Thus, this modified process further contemplates a surface roughening step that may be by the traditional caustic etch, abrasive blasting or other technique. The caustic etch may be beneficially followed by the acid dip process described above. Alternatively, the caustic etch step can be eliminated and the pre-anodizing step can be followed by the acid dip process. In either case, a final anodization can be applied to the treated aluminum surface to complete the process. This modified process results in very high density small pit structures, as shown in the SEM picture of FIG. 7 of a surface that is pre-anodized and acid dipped without caustic etch, and in the SEM picture of FIG. 8 of an aluminum surface that is pre-anodized followed by a caustic etch without acid dip. There are only minimal protrusions or intermetallic particles and the pit edges are smoother with these two processes. The surface prepared by pre-anodization and caustic etch in FIG. 8 carries more sharp protrusions than the surface prepared by pre-anodization followed by acid dip in FIG. 7. Nevertheless, the higher density pit structure provided even with the caustic dip presents an improvement over the conventionally prepared aluminum surface. Thus, while the pre-anodized/caustic etch surface may not significantly reduce blade wear, it retains the benefit of reduce oil consumption due to the high density small pit structure.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An imaging transfer member for a printing machine, the member having an imaging surface with an average surface roughness of about 0.2 to 0.4 micrometers and an average maximum profile peak height of about 0.2 to 0.5 micrometers.

2. The imaging transfer member of claim 1, wherein the imaging surface includes a plurality of pits having a pit density of 50 per millimeter square to about 10000 per millimeter square.

3. The imaging transfer member of claim 1, wherein the imaging surface is formed of aluminum.

4. The imaging transfer member of claim 3, wherein the imaging surface is anodized.

* * * * *